US005363637A

United States Patent [19]

Hirai

[11] Patent Number: 5,363,637

[45] Date of Patent: Nov. 15, 1994

[54] METHOD OF THREADING IN A FALSE TWISTING MACHINE AND AN APPARATUS FOR CARRYING OUT THE SAME

[75] Inventor: Kazuyasu Hirai, Nagaokakyo, Japan

[73] Assignee: Murata Kikai Kabushiki Kaisha, Kyoto, Japan

[21] Appl. No.: 56,995

[22] Filed: May 3, 1993

[30] Foreign Application Priority Data

May 7, 1992 [JP] Japan ..... 4-143195

[51] Int. Cl.[5] ..... D01H 9/10; D01H 13/30

[52] U.S. Cl. ..... 57/269; 57/286; 57/296

[58] Field of Search ..... 57/268, 269, 278, 280, 57/286, 296

[56] References Cited

U.S. PATENT DOCUMENTS 3,257,790 6/1966 Dudzik et al. ..... 57/286
4,000,604 1/1977 Lee ..... 57/286 X
4,117,656 10/1978 Ingham ..... 57/278
4,308,716 1/1982 Bauer ..... 57/286
4,380,144 4/1983 Henry ..... 57/286

FOREIGN PATENT DOCUMENTS 2378881 9/1978 France ..... 57/280
1909697 12/1969 Germany ..... 57/286

*Primary Examiner*—Joseph J. Hail, III
*Attorney, Agent, or Firm*—Spensley Horn Jubas & Lubitz

[57] ABSTRACT

A method of threading in a false twisting machine, capable of surely attracting the free end of a yarn by suction and of preventing the yarn from slacking during a threading operation. A traveling doffer travels along a false twisting machine which oils yarn with oiling rollers and takes up the oiled yarns in yarn packages. During the doffing operation, the free end of the yarn extending on the delivery side of the oiling roller is sucked, while the yarn is separated from the oiling roller.

7 Claims, 6 Drawing Sheets

METHOD OF THREADING IN A FALSE TWISTING MACHINE AND AN APPARATUS FOR CARRYING OUT THE SAME

BACKGROUND OF THE INVENTION

1. Field of the Invention

The present invention relates to a method of threading in a false twisting machine in which a yarn is oiled after processing a yarn false twists and taken up on a package.

2. Prior Art

First, the general construction of a false twisting machine will be described with reference to FIG. 6. Each of yarns Y pulled out from yarn packages 51 supported on a creel 50 is stretched between a first feed roller 53 and a second feed roller 54 at a yarn tension for drawing. A false twisting device 55, such as a belt-type false twisting device, is disposed between the feed rollers 53 and 54 near the second feed roller 54. The false twisting device 55 inserts twists in a portion of the yarn Y extending on the feed side of the false twisting device 55 and untwists a portion of the yarn Y extending on the delivery side of the false twisting device 55. A primary heater 56 for heat-setting the yarn Y is disposed between the feed rollers 53 and 54 near the first feed roller 53 to heat the twisted portion of the yarn Y to a drawing temperature. A third feed roller 57 is disposed after the second feed roller 54, and a secondary heater 58 is disposed between the feed rollers 54 and 57 to reheat the yarn Y when necessary. The reheated yarns Y are wound in textured yarn packages 60 by a take-up winder 59.

Each of oiling rollers 1 is disposed between the third feed roller 57 and the take-up winder 59. The yarn is oiled with the oiling roller 1 before taking up to ensure that the yarn can be smoothly unwound from the package. When a textured yarn package becomes a full package, a traveling doffer 66 transfers the full package 60 from the take-up winder 59 to a rotary creel 63 and puts an empty bobbin on the take-up winder 59. The traveling doffer 66 travels along a rail 68 extended on a passage between a false twisting machine body 61 and the primary heater 56. The traveling doffer 66 travels along the false twisting-machine body 61 to doff full packages and to put empty bobbins on the take-up winder 59.

The traveling doffer 66 will be described hereinafter with reference to FIG. 5, in which FIG. 5*a* is a front view and FIG. 5*b* is a side view of the traveling doffer 66. The traveling doffer 66 has three doffing units each consisting of a chucking hand 75, a package support 76, a bobbin chuck 77 and a cradle opener 78. The cradle opener 78 opens the cradle of the false twisting machine body 61 supporting a full package 60, the chucking hand 75 holds the full package 60, the package support 76 supports the full package 60, the bobbin chuck 77 takes an empty bobbin from the rotary peg 63 and puts the empty bobbin on the cradle, and then, the package support 76 puts the full package 60 on the rotary peg 63 shown in FIG. 6. A threading device 70 is mounted for vertical movement on the travelling doffer 66. A nozzle included in a positioning device 72 blows air and a suction nozzle 71 sucks the free end of the yarn and attaches the free end of the yarn to the empty bobbin. Since the false twisting machine body 61 operates continuously while the yarn is cut to doff the full yarn package and the threading device 70 attaches the free end of the yarn to the empty bobbin, the suction nozzle 71 continues to suck the free end of the yarn to prevent the yarn from slacking.

As shown in FIG. 4, the positioning device 72 has a screw jack 41 connected to a driving device 40 to move two wheels 42 and 43 laterally, as viewed in FIG. 4. The Screw jack 41 fits the two wheels 42 and 43 in grooves 44 and 45 formed in the false twisting machine body 61 for positioning. The positioning device 72 is provided with a nozzle 73. The nozzle 73 is advanced together with the two wheels 42 and 43 as far as the nozzle 73 is joined to a coupling 74. Then, compressed air is supplied in the direction of the arrows ① and ② through a pipe to the suction nozzle 71 of the threading device 70 to use the compressed air for sucking the free end of the yarn (FIG. 6).

The operation of the threading device 70 will be described hereinafter with reference to FIG. 3, in which FIG. 3*a* shows the threading device 70 in a free end sucking operation and FIG. 3b shows the threading device 70 in a threading operation. When the textured yarn is wound in a full package 60, a cutter, not shown, cuts the yarn at a position on the delivery side of the oiling roller 1 and, at the same time, the suction nozzle 71 starts sucking the free end of the yarn. During this operation, the threading device 70 is positioned at a lower position a with respect to the traveling doffer 66 as shown in FIG. 3*a*. After the full package 60 has been transferred to the rotary peg 63 and an empty bobbin 67 has been transferred from the rotary peg 63 to the cradle of the false twisting machine body 61, the threading device 70 is raised to positions b, c and d sequentially to attach the free end of the false twisted yarn to the empty bobbin 67.

Since this method of threading in a false twisting machine cuts a portion of the yarn extending on the delivery side of the oiling roller and sucks the free end of the yarn, the free end of the yarn must be pulled by a suction force exceeding the viscous resistance of the oil. Recently, the operating speed of the false twisting machine has been progressively increased to increase the yarn speed from about 800 m/min to 1000 m/min or above. Since the viscous resistance of the oil is proportional to the square of the yarn speed, the oiling roller resists greatly against the running of the yarn particulary in a cold season, such as winter, in which the viscous resistance of the oil increases, so that the suction nozzle is liable to fail in sucking the free end of the yarn due to the slacking of the yarn.

SUMMARY OF THE INVENTION

The present invention has been made in view of the foregoing problem in the prior art and it is therefore an object of the present invention to provide a method of threading in a false twisting machine, capable of sucking the free end of the yarn without fail and of preventing the slacking of the yarn during the threading operation, and an apparatus for carrying out the method.

The present invention provides a method of threading in a false twisting machine and an apparatus for carrying out the same by sucking the free end of a yarn extending on the delivery side of an oiling roller and threading the yarn on an empty bobbin when a full package has been doffed by a traveling doffer that travels along a false twisting machine which false twists a yarn and takes up the yarn in a package after oiling the yarn with an oiling roller, in which the free end of the false twisted yarn is separated from the oiling roller by a separating means so that the yarn does not contact with the oiling roller during a threading operation.

Since the yarn is separated from the oiling roller and travels free during the threading operation, the free end of the false twisted yarn can be sucked without undergoing the viscous resistance of the oil.

DETAILED DESCRIPTION OF PREFERRED EMBODIMENT

Figure 1A:
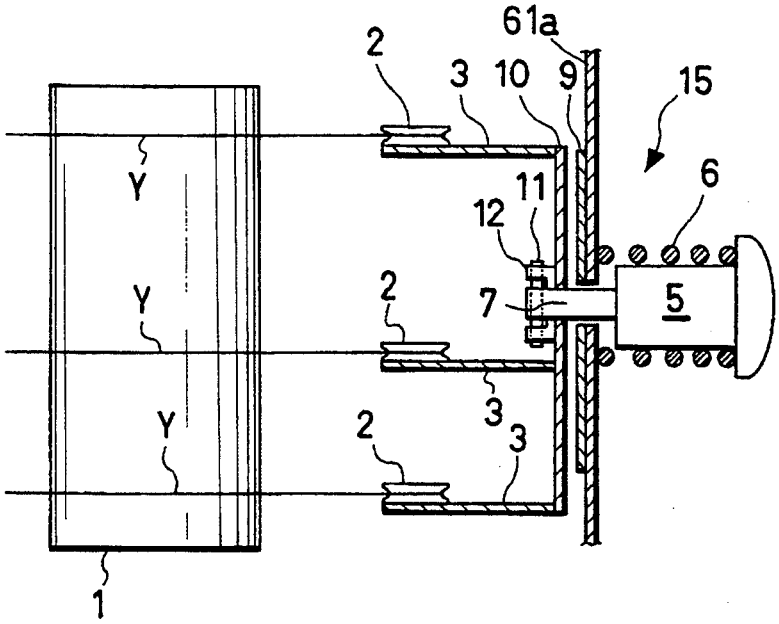
FIGS. 1*a* and 1*b* are sectional views of a yarn lifting device employed in carrying out a method of threading in a false twisting machine in accordance with the present invention.
Figure 1B:
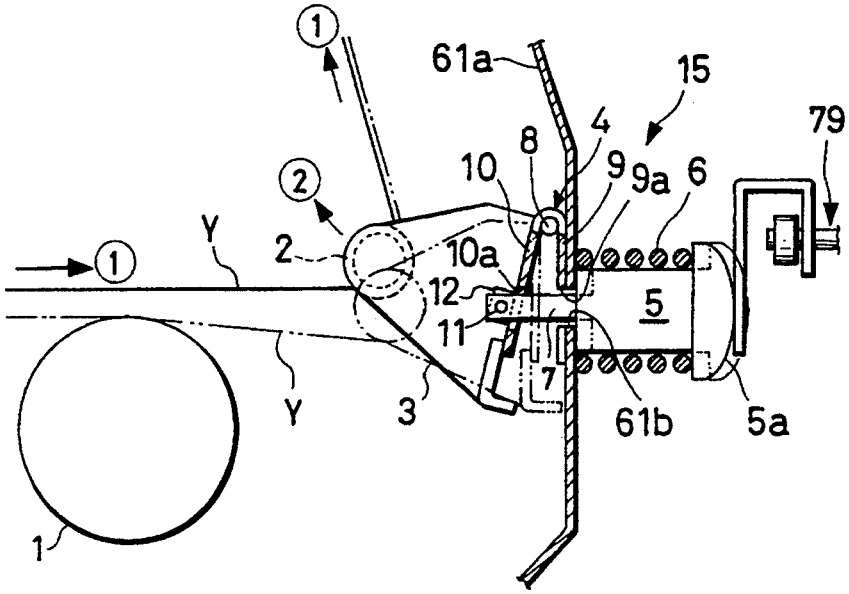
Figure 6:
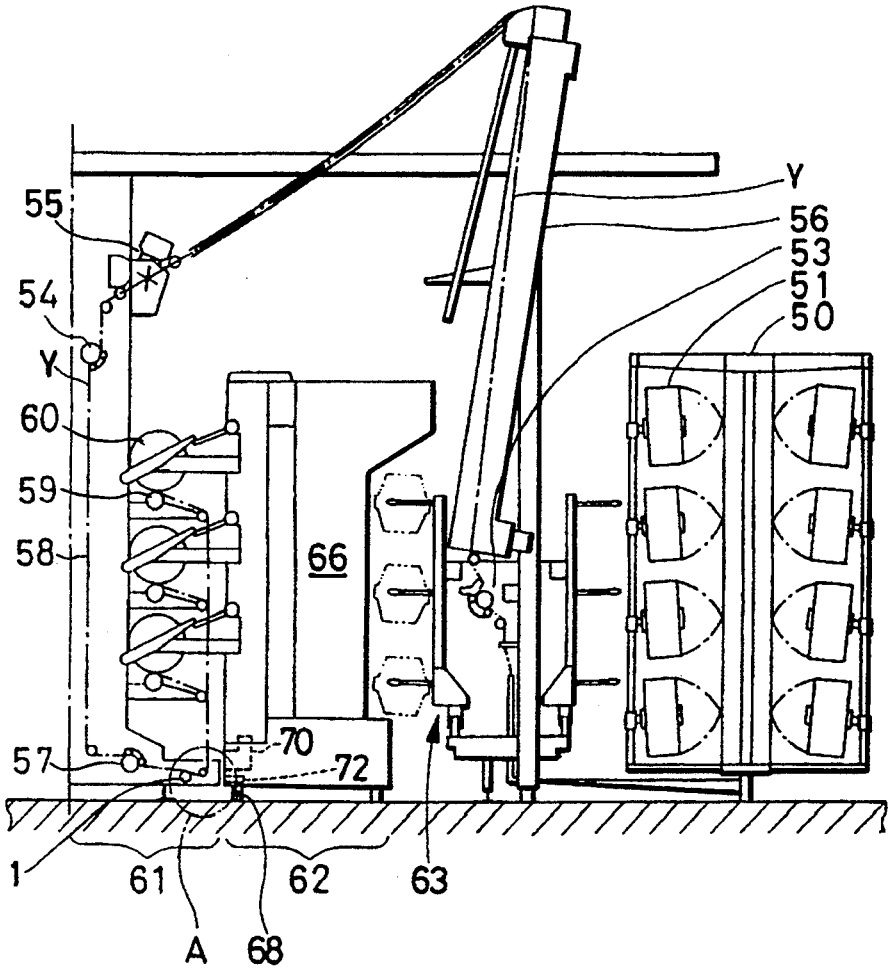
FIG. 6 is an end view of the false twisting machine.

A preferred embodiment of the present invention will be described hereinafter with reference to the accompanying drawings. FIG. 1 shows a yarn lifting device 15 for carrying out a method of threading in a false twisting machine in accordance with the present invention, in which FIG. 1*a* is a sectional plan view and FIG. 1*b* is a sectional side view. The yarn lifting device 15 is disposed in a portion A of the false twisting unit 61 shown in FIG. 6.

Shown in FIG. 1 are a side plate 61*a* of the false twisting unit 61, an oiling roller 1, a guide pulley 2 for guiding a yarn, a bracket 3, a hinge 4, a button 5 and a compression spring 6.

Figure 4:
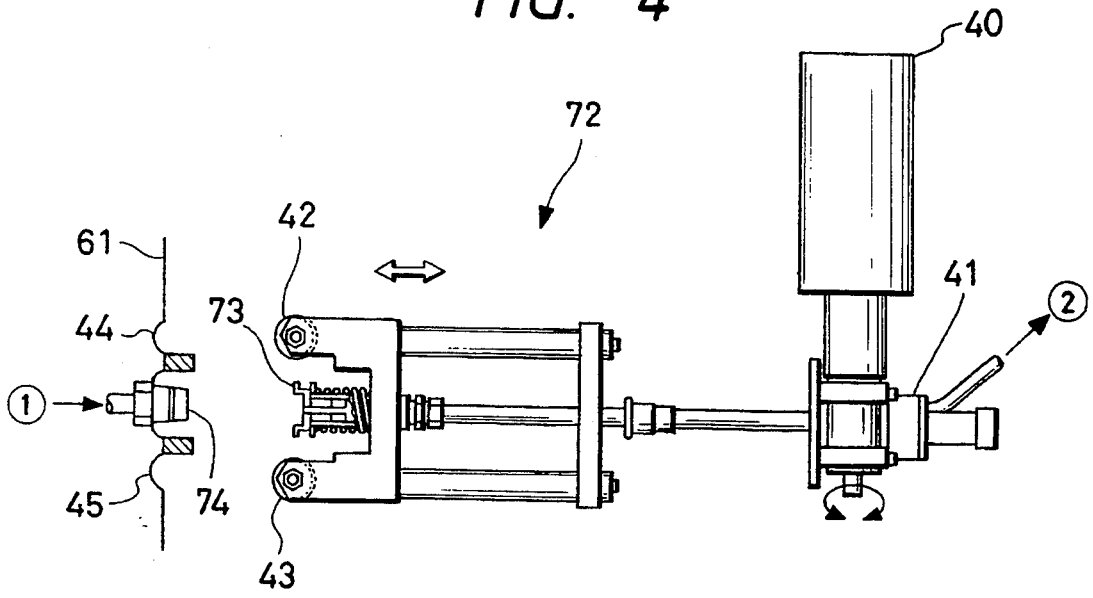
FIG. 4 is a plane view of a positioning device of the traveling doffer.
Figure 5A:
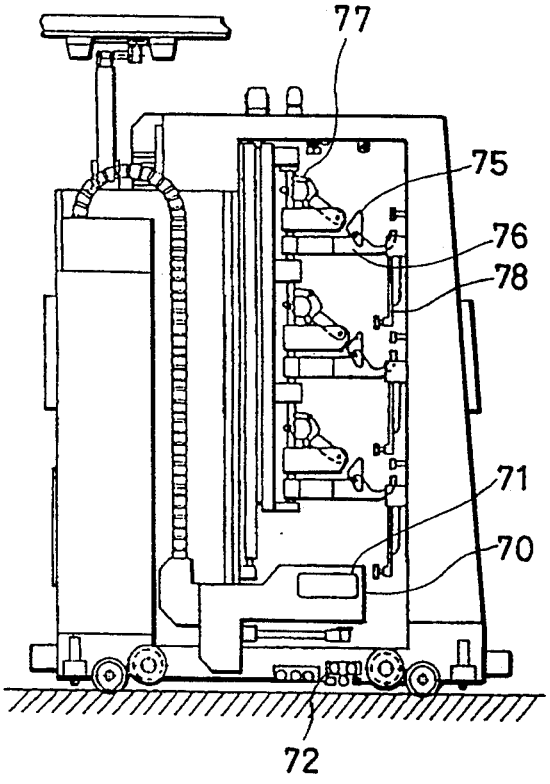
FIGS. 5*a* and 5*b* are views of the traveling doffer.
Figure 5B:
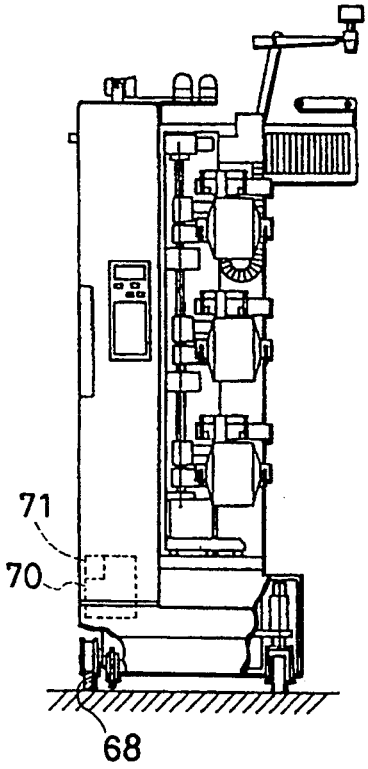

The compression spring 6 is mounted on the stem 7 of the button 5, and the stem 7 is inserted through a hole 61*b* formed in the side plate 61*a* of the false twisting unit 61. The hinge 4 has a hinge pin 8, a fixed plate 9 fixed to the side plate 61*a*, and a swing plate 10 joined to the fixed plate 9 with the hinge pin 8. Holes 9*a* and 10*a* are formed respectively in the fixed plate 9 and the swing plate 10 at positions coinciding with the hole 61*b* of the side plate 61*a*. The stem 7 of the button 5 extends through the holes 9*a* and 10*a*, and a pin 11 supported on a knuckle 12 attached to the swing plate 10 penetrates the free end of the stem 7. When the button 5 is pushed, the stem 7 moves to the left as viewed in FIG. 1*b* to swing the swing plate 10. Three brackets 3 are attached to the swing plate 10, and the three guide pulleys 2 are supported respectively on the three brackets 3 to guide the yarns to three take-up winders 59 disposed one over another in a vertical arrangement on the false twisting unit 61. During the normal operation of the false twisting unit 61, the hinge 4 is closed by the compression spring 6 as indicated by alternate long and two short dashes lines in FIG. 1*b*, each yarn Y is kept in contact with the corresponding oiling roller 1 for oiling and travels in the direction of the arrow (1), and the take-up winder 59 winds the yarn Y in a package. Although the guide roller 2 is pulled by the tension of the yarn Y in the direction of the arrow (2), the guide roller 2 is retained at a position indicated by alternate long and two short dashes lines by the resilient force of the compression spring 6. In a doffing operation, a pushing device 79 interlocked with the positioning device 72 (FIG. 4) of the traveling doffer pushes the button 5 at its head 5*a* to the left, as viewed in FIG. 1*b* against the resilience of the compression spring 6. Then, the pulley 2 supported on the bracket 3 attached to the Swing plate 10 swings on the hinge pin 8 of the hinge 4 to separate the yarn Y from the oiling roller 1.

Figure 2A:
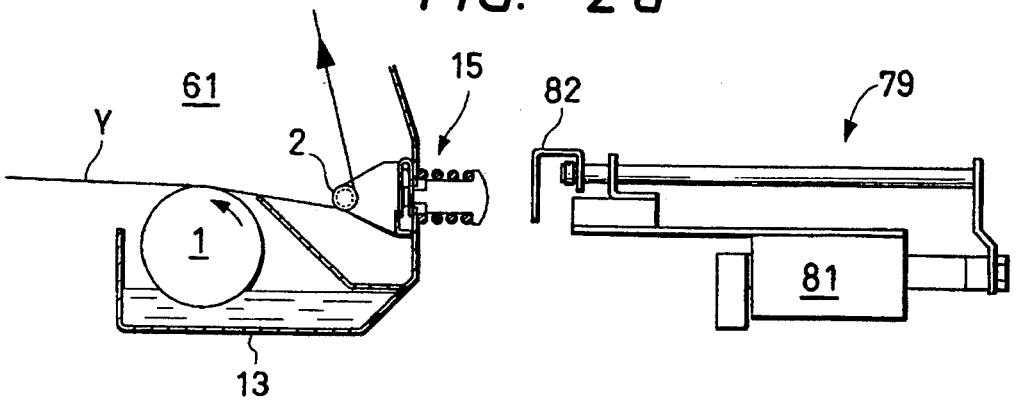
FIGS. 2*a* and 2*b* are views of assistance in explaining the operation of the yarn lifting device employed in carrying out a method of threading in a false twisting machine in accordance with the present invention.
Figure 2B:
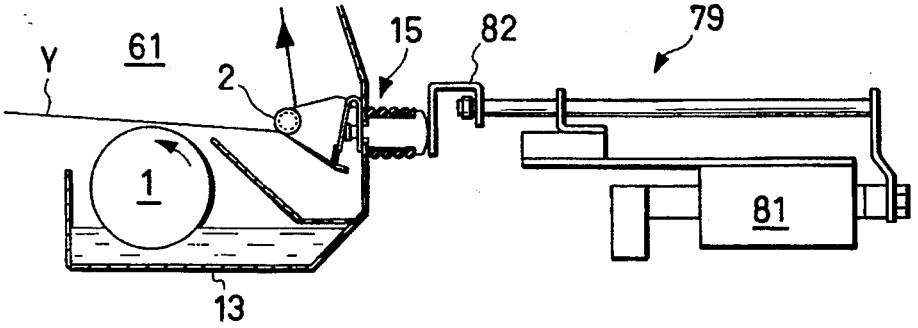
Figure 3A:
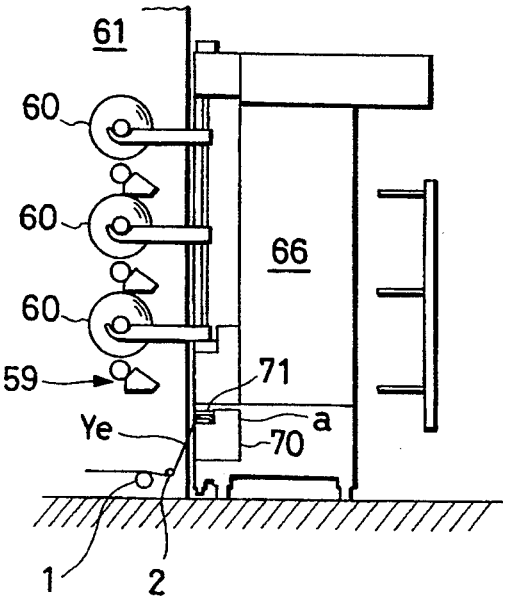
FIGS. 3*a* and 3*b* are side views showing a threading device included in a traveling doffer.
Figure 3B:
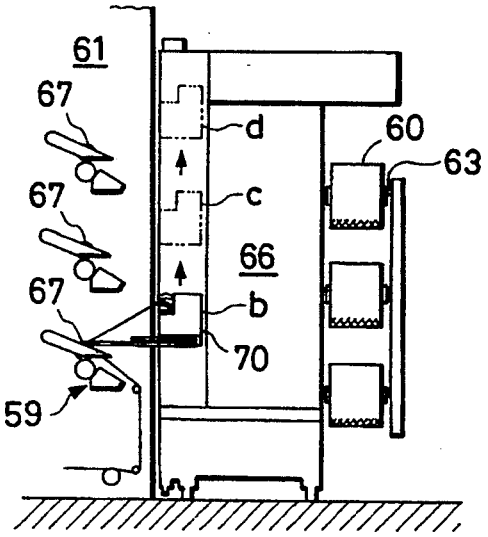

The operation of the yarn lifting device 15 will be described with reference to FIG. 2 in which FIG. 2*a* is a view of the yarn lifting device 15 in an inoperative state and FIG. 2*b* is a view of the same in an operative state. FIG. 2 is an enlarged view of the portion A shown in FIG. 6. The pushing device 79 disposed, for example, on the lower portion of the positioning device 72 has a pushing plate 82 and a cylinder actuator 81 for operating the pushing plate 82. The oiling roller 1 is supported for rotation so as to be partly immersed in the oil contained in an oil container 13 disposed in the lower portion of the false twisting unit 61. The oiling roller 1 is rotated counterclockwise at a low rotating speed to oil the yarn Y with the oil spreading in a film over the circumference of the oiling roller 1. During the normal operation of the false twisting unit 61, the yarn Y travels in sliding contact with the oiling roller 1 as shown in FIG. 2*a*, so that the yarn Y is oiled. When doffing a full package, the traveling doffer 66 is positioned in place beside the false twisting unit 61, the pushing device 79 is advanced together with the positioning device 72 as shown in FIG. 2*b*. Then, the guide pulley 2 is caused to swing to separate the yarn Y from the oiling roller 1.

The threading operation of the yarn lifting device 15 will be described hereinafter. When a full package 60 is completed, the traveling doffer 66 is positioned beside the false twisting unit 61, and then the pushing device 79 is advanced toward the false twisting unit 61. Then, the yarn lifting device 15 lifts up the yarn Y to separate the same from the oiling roller 1. Immediately after, a threading device 70, mounted on the traveling doffer 66, cuts a portion of the yarn extending on the delivery side of the oiling roller 1, attracts the free end of the yarn by suction and attaches the free end of the yarn to an empty bobbin put on the take-up winder 59 of the false twisting unit 61. Since the yarn Y is separated from the oiling roller 1 during the threading operation, the yarn is free from the viscous resistance of the oil and can be easily attracted by suction, so that the threading operation can be achieved without fail. After the threading operation has been completed, the pushing device 79 is retracted, the suction nozzle 71 stops sucking the free end of the yarn, the yarn lifting device 15 restores the state as shown in FIG. 2*a* so that the false twisted yarn Y is brought into contact with the oiling roller 1 again for oiling. The yarn may be separated from the oiling roller 1 by moving the oiling roller away from the yarn instead of lifting up the yarn.

The viscous resistance of the oil that tends to cause the yarn to stick to the oiling roller has increased to a level which cannot be ignored with the increase of the operating speed of the false twisting machine. Accordingly, the method of threading in a false twisting machine and the apparatus for carrying out the method threads the false twisting machine after separating the yarn from the oiling roller, so that the yarn does not undergo the viscous resistance of the oiling roller when the yarn is attracted by suction during the threading operation. Thus, the yarn can be surely sucked and the sucked yarn will not slack, so that the threading operation can be achieved without fail.

The false twisting machine in the foregoing embodiment is provided with the traveling doffer. A false twisting machine in another embodiment according to the present invention having a plurality of false twisting units each provided with a take-up winder 59 capable of doffing a yarn package will be described hereinafter. An essential portion of the false twisting machine having the plurality of false twisting units each capable of a doffing operation will be described with reference to FIG. 7.

Figure 7:
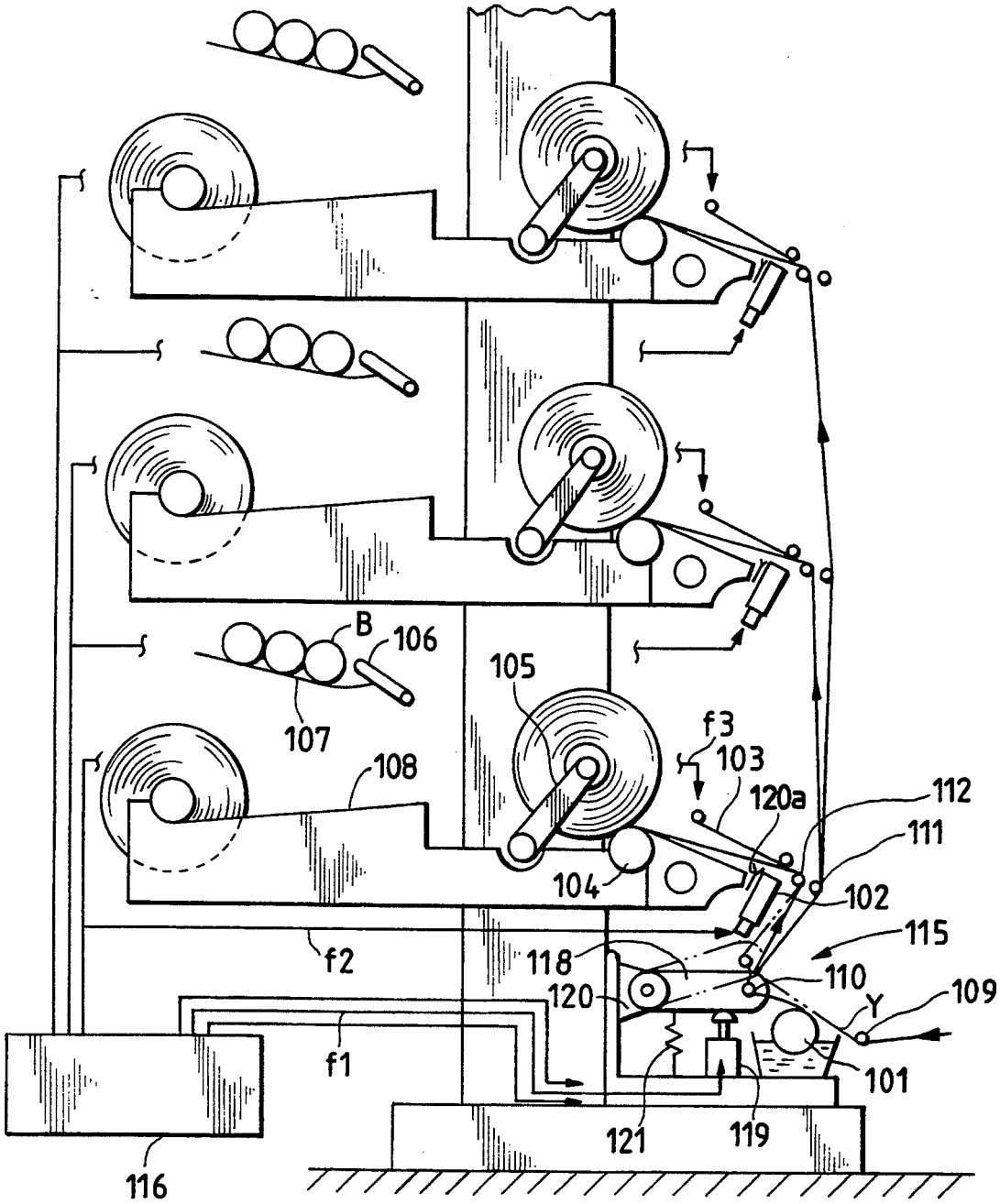
FIG. 7 is a schematic view illustrating a false twisting machine having a doffing mechanism.

Referring to FIG. 7, take-up winders, similar to those of the foregoing embodiment, are disposed one over another in a vertical arrangement. Shown in FIG. 7 are an oiling roller 101, suction nozzles 102, threading levers 103, driving rollers 104, swing cradle arms 105 for holding yarn packages P, chucks 106 for chucking an empty bobbin B, bobbin stockers 107, yarn package stockers 108, yarn guides 109 to 112, a yarn lifting device 115, i.e., the yarn separating means, and a controller 116 for controlling the take-up winders for doffing operation, and the yarn lifting device 115 for yarn lifting operation.

Figure 8A:
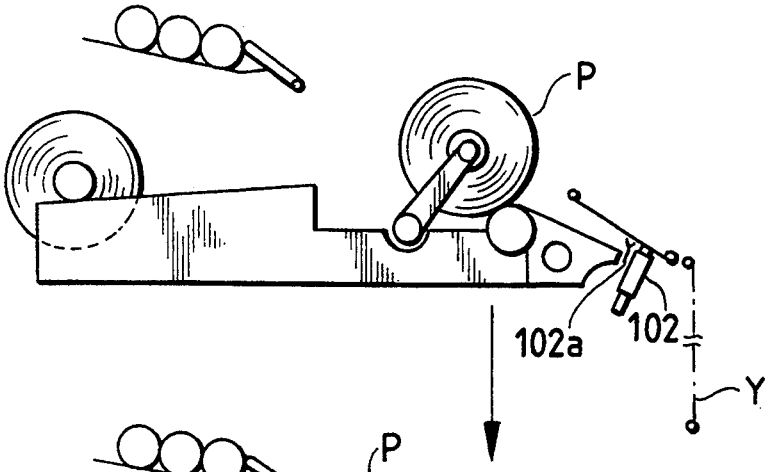
FIGS. 8*a* to 8*d* are schematic illustrations showing the doffing operation of the false twisting machine in FIG. 7.
Figure 8B:
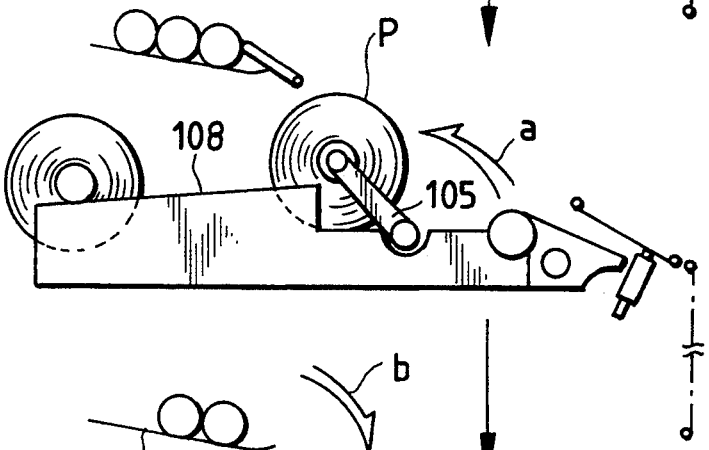
Figure 8C:
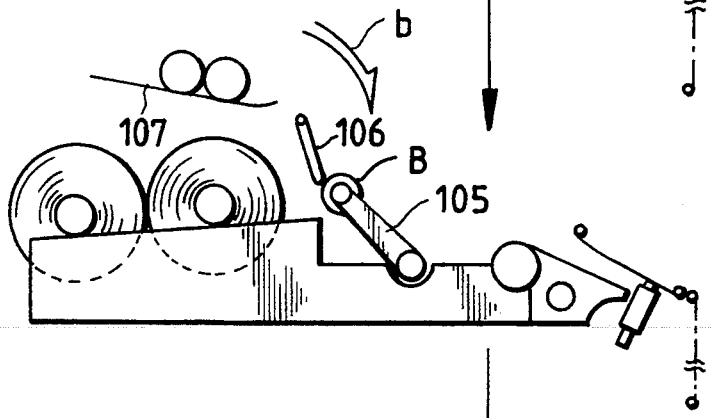
Figure 8D:
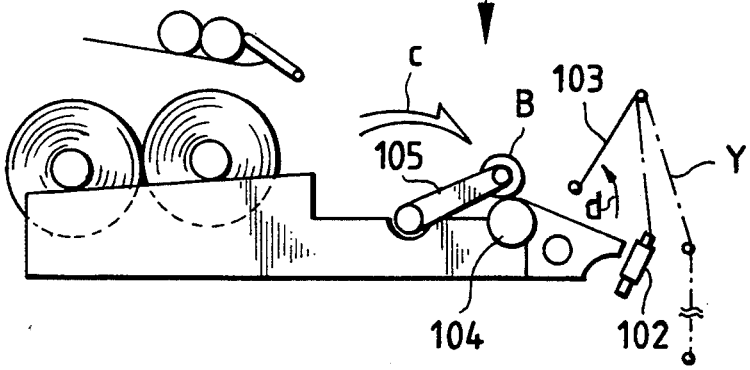

A doffing procedure to be carried out by the false twisting machine of FIG. 7 will be explained with reference to FIG. 8. In FIG. 8*a* shows a state where a full yarn package P has been formed and a doffing operation is required. First, the suction nozzle 102 starts sucking the false twisted yarn Y, a yarn cutter 102*a* disposed near the suction nozzle 102 cuts the yarn Y, and then the suction nozzle 102 sucks the free end of the yarn Y. Then, as shown in FIG. 8*b*, the cradle arm 105 is turned in the direction of the arrow a and releases the full yarn package P. The yarn package P is stocked in the yarn package stocker 108. Then, as shown in FIG. 8*c*, the chuck 106 chucks the bobbin B stored in the bobbin stocker 107 and turns in the direction of the arrow b. Then, the cradle 105 holds the bobbin B. Then, the cradle arm 105 turns in the direction of the arrow c to bring the bobbin B into contact with the driving roller 104 and the driving roller 104 drives the bobbin B for rotation. Then, the threading lever 103 catches the yarn Y being sucked into the suction nozzle 102 and turns in the direction of the arrow d to attach the free end of the false twisted yarn Y to the bobbin B. Then, the threading lever 103 returns to its initial position and the take-up winder starts taking up the yarn Y on the bobbin B. The suction of the suction nozzle 102 is stopped after the yarn Y has been caught by the threading lever 103.

As shown in FIG. 7, the yarn lifting device 115 comprises, as principal components, a hinge lever 118 and a solenoid actuator 119. The hinge lever 118 is supported for swing motion on a bracket 120 and biased toward the solenoid actuator 119 by a spring 121. Normally, the hinge lever 118 is in contact with one end of the solenoid actuator 119. The yarn lifting devices 115 respectively for the plurality of take-up winders are disposed respectively one over another in a vertical arrangement and arranged in a row in a direction perpendicular to the paper. The yarn lifting devices 115 are able to operate individually. Only one of the yarn lifting devices 115 for the take-up winders on the bottom row is shown in FIG. 7.

When a signal f1 provided by the controller 116 is given to the solenoid actuator 119, the plunger of the solenoid actuator 119 projects from the solenoid to turn the hinge lever 118 from a position indicated by continuous lines to a position indicated by alternate long and two short dashes lines. When the hinge lever 118 is positioned at the position indicated by continuous lines, the yarn Y guided by the yarn guide 117 is in contact with the circumference of the oiling roller 101 and is oiled by the oiling roller 101. When the hinge lever 118 is positioned at the position indicated by the alternate long and two short dashes lines, the yarn Y guided by the yarn guide 117 is separated from the oiling roller 101.

The controller 116 controls each false twisting unit for doffing operation. For example, the controller 116 gives each false twisting unit a signal f2 requesting the suction nozzle 102 to start suction and the yarn cutter 102*a* to operate. At the same time, the controller 116 gives the solenoid actuator 119 the signal f1 to actuate the solenoid actuator 119. Upon the reception of a signal f3 indicating the completion of operation of the threading lever 103, the controller 116 makes the solenoid actuator 119 inoperative.

A threading method using the yarn lifting device 115 will be described hereinafter. Suppose that the take-up winder on the bottom row has started the dolling operation. Then, the controller 116 provides the signal f2 for actuating the suction nozzle 102 and the signal f1 for actuating the solenoid actuator 119 simultaneously. Consequently, the hinge lever 118 is shifted to the position indicated by alternate long and two short dashes lines to separate the yarn Y from the oiling roller 101 so that the yarn Y is free from the resistance of the oiling roller 101. Then, the yarn Y is immediately cut by the yarn cutter 102. When the yarn Y is cut by the yarn cutter 102, the free end of the yarn Y is sucked into the suction nozzle 102 without fail. In the final stage of the doffing operation, the controller 116 receives a signal f3 indicating the completion of operation of the threading lever 103, and then the controller 116 makes the solenoid actuator 119 inoperative. Then, the hinge lever 118 is returned to the position indicated by the continuous lines and the yarn Y is brought into contact with the oiling roller 101, so that the yarn Y is taken up on the bobbin after being oiled by the oiling roller 101. Since the length of the yarn Y sucked into the suction nozzle 102 during the doffing operation of each take-up winder is not oiled and thrown away, the oil is not wasted. Since oiling of the yarn Y can be started substantially simultaneously with the start of the normal yarn winding operation, only a small portion of the yarn is not oiled.

What is claimed is:

1. In a false twisting machine for false twisting yarn, a threading method comprising the steps of:

providing an oiling roller for oiling the yarn, providing a take up means for taking up the yarn into a yarn package, removing a full yarn package from the take-up means and putting an empty bobbin on the take-up means, threading yarn onto the empty bobbin, the step of threading yarn onto the empty bobbin comprising the step of catching a free end of yarn received from the oiling roller via suction force, and separating the yarn and the oiling roller to thereby eliminate contact between the yarn and the oiling roller during the step of threading yarn onto the empty bobbin.

2. The method of claim 1, wherein the step of removing a full yarn package from the take-up means and putting an empty bobbin on the take-up means comprises providing a traveling doffer for traveling along the false twisting machine.

3. In a false twisting machine for false twisting yarn, a threading apparatus comprising:

an oiling roller for oiling the yarn, take-up means for taking up the yarn into a yarn package, doffing means for removing a full yarn package from the take-up means and putting an empty bobbin on the take-up means, means for threading yarn onto the empty bobbin, including suction means for catching a free end of yarn received from the oiling roller, and yarn separating means for separating the yarn and the oiling roller to thereby eliminate contact between the yarn and the oiling roller when yarn is threaded onto the empty bobbin.

4. The apparatus of claim 3, wherein the doffing means comprises a traveling doffer for traveling along the false twisting machine.

5. The apparatus of claim 4, wherein the yarn separating means comprises:

a button having an end portion and being mounted on a compression spring;

a hinge having a hinge pin, a fixed plate, a swing plate joined to the fixed plate via the hinge pin, at least one guide pulley for guiding a yarn, the guide pulley being supported on the swing plate and being connected to the end portion of the button; and a pushing device provided on the traveling doffer for pushing the button, whereby the swing plate is caused to swing about the hinge pin and the yarn is separated from the oiling roller when the button is pushed by the pushing device.

6. The apparatus of claim 5, comprising a positioning device provided on the traveling doffer and connected with the pushing device.

7. The apparatus of claim 3, wherein the yarn separating means comprises:

a pivotable hinge lever having a yarn guide through which the yarn is guided, a solenoid actuator having a projectable plunger positioned to contact the hinge lever, means for biasing the hinge lever toward the solenoid actuator, whereby projection of the plunger from the solenoid toward the hinge lever causes the hinge lever to pivot away from the oiling roller and causes yarn guided by the yarn guide to be separated from the oiling roller.

* * * * *